United States Patent [19]

Heinrich et al.

[11] Patent Number: 4,487,011

[45] Date of Patent: Dec. 11, 1984

[54] PROCESS FOR MAKING A TEXTURIZED PROFILE YARN, AND THE RESULTING YARNS

[75] Inventors: Karl Heinrich, Grossaitingen; Norbert Heichlinger, Königsbrunn, both of Fed. Rep. of Germany

[73] Assignee: Hoechst Aktiengesellschaft, Fed. Rep. of Germany

[21] Appl. No.: 367,168

[22] Filed: Apr. 12, 1982

[30] Foreign Application Priority Data

Apr. 18, 1981 [DE] Fed. Rep. of Germany ..... 3115759

[51] Int. Cl.[3] ..... D02G 3/02; D02G 1/02

[52] U.S. Cl. ..... 57/247; 57/248; 57/284

[58] Field of Search ..... 57/243, 246, 247, 248, 57/287, 288, 310, 284, 290, 282

[56] References Cited

U.S. PATENT DOCUMENTS

| | | | |
|---|---|---|---|
| 3,091,912 | 6/1963 | Stoddard et al. | 57/247 |
| 3,094,834 | 6/1963 | Deeley et al. | 57/288 |
| 3,404,525 | 10/1968 | Tompkins | 57/288 X |
| 3,488,940 | 1/1970 | Mehta | 57/288 |
| 3,529,323 | 9/1970 | Hughey | 57/248 X |
| 3,695,026 | 10/1972 | Taylor | 57/288 X |
| 3,797,221 | 3/1974 | Ikeda | 57/247 |
| 3,910,027 | 10/1975 | Bach | 57/288 |
| 3,936,999 | 2/1976 | Ikeda et al. . | |
| 4,019,311 | 4/1977 | Schippers | 57/247 X |
| 4,041,689 | 8/1977 | Duncan et al. | 57/248 |
| 4,173,860 | 11/1979 | McKlveen | 57/288 X |

FOREIGN PATENT DOCUMENTS 2009666 6/1979 United Kingdom .

*Primary Examiner*—Donald Watkins
*Attorney, Agent, or Firm*—Connolly and Hutz

[57] ABSTRACT

The invention relates to a process for making texturized multifilament yarns having profiled polyester filaments, by means of draw false twist texturizing, wherein feed yarns which are multifilament yarns having a high pre-orientation which corresponds to a birefringence of more than $65\times10^{-3}$ are simultaneously drawn and false twist texturized without a reduction of the twist number but at temperatures which are no more than 30° C. above the glass transition temperature (second order transition temperature) of the polymer and to the resulting luster yarns, the cross-section profiles of which are largely retained in this special texturizing process.

7 Claims, 4 Drawing Figures

PROCESS FOR MAKING A TEXTURIZED PROFILE YARN, AND THE RESULTING YARNS

The present invention relates to a process for making texturized profile yarns in which the profile has been substantially retained by simultaneous drawing and false twist texturizing of pre-oriented polyester yarns and to the resulting luster yarns.

Certain fashion effects require luster yarns, ie. texturized yarns which are comprised of filaments with a very marked profile and have only a relatively small amount of crimp. For economic reasons, texturized yarns today are predominantly made by simultaneous draw texturizing of high-speed yarns. However, simultaneous draw texturizing increases the typical false twist texturizing tendency of filaments, independently of their original cross-section, to assume a more or less hexagonal cross-section, as has been illustrated, for example by Bigler in "Melliand Textilberichte" 1969, page 85 et seq.

In the conventional false twist texturizing process, in which already completely drawn yarns are introduced into the texturizing machine, it is known, for example from German Auslegeschrift No. 2,101,315, that a smaller amount of twist and also a somewhat reduced texturizing temperature lead to an improved retention of the profile. However, these measures are not successful in the case of simultaneous draw texturizing, not even when using so-called high-speed yarns as described, for example, in German Offenlegungsschrift No. 2,211,843.

One way of making yarns from sharply profiled filaments which have a slight crimp is described in European Laid-Open Application No. 11,915. In this process, yarns which have been spun at a high speed and are comprised of a profiled material are subjected to a gear-crimping process. This crimping process, as is known, produces a relatively low deformation of the monofilaments. The deformations are usually limited to those parts of the filaments where a change of direction was forced onto the filaments. However, the gear-crimping process has the disadvantage that all the filaments of a yarn are given a uniform and equiphase crimp so that in textile sheet structures produced therefrom undesirable patterns necessarily arise. In contrast, false twist crimping produces a three-dimensional, randomly uniform crimp. The processing of yarns of this type does not produce any noticeable patterns.

It is also clear from the abovementioned European Laid-Open Application No. 11,915 that the hitherto prevalent opinion was that it is completely impossible to produce filaments having a relatively slight crimp by means of a false twist process.

The object was therefore still to provide a process for making texturized profile yarns in which process polyester filament yarns which have been spun at a high speed can be simultaneously drawn and false twist texturized while retaining their profile, without producing the known and undesirable deformation of the filaments into hexagonals. The filaments are also intended to have only a low bulk which approximately corresponds to that of set yarns. The shrinkage of these yarns, expressed in terms of the heat shrinkage at 200° C., should not exceed 20% and if possible be even below 10%.

It has now been found, surprisingly, that it is possible to process highly pre-oriented filament yarns into these desired yarns by subjecting them to a simultaneous draw false twist texturizing process wherein the filaments are drawn and texturized at a temperature which is less than about 30° C. above the second order transition temperature (for how this is defined, see Ludewig, "Polyesterfasern [Polyester Fibers]", Akademieverlag Berlin (1975), pages 13 and 14) of the filaments.

Highly pre-oriented filaments and yarns are understood here as meaning those which have a birefringence of more than $65\times10^{-3}$, which corresponds to a take-off spinning speed of about 4,000 meters or more per minute. The false twist imparted to the yarns should have the order of magnitude which is given by the Heberlein formula (compare, for example, British Pat. No. 707,839, claim 1), or be still higher.

The simultaneous draw false twist texturizing required according to the invention is preferably carried out at room temperature, without the use of a heating device.

The birefringence of the feed yarns is usually chosen to be below $120\times10^{-3}$, preferably even below $90\times10^{-3}$, ie. in conventional spinning plants take-off spinning speeds of below 5,000 meters per minute are usually used.

Figure 1:
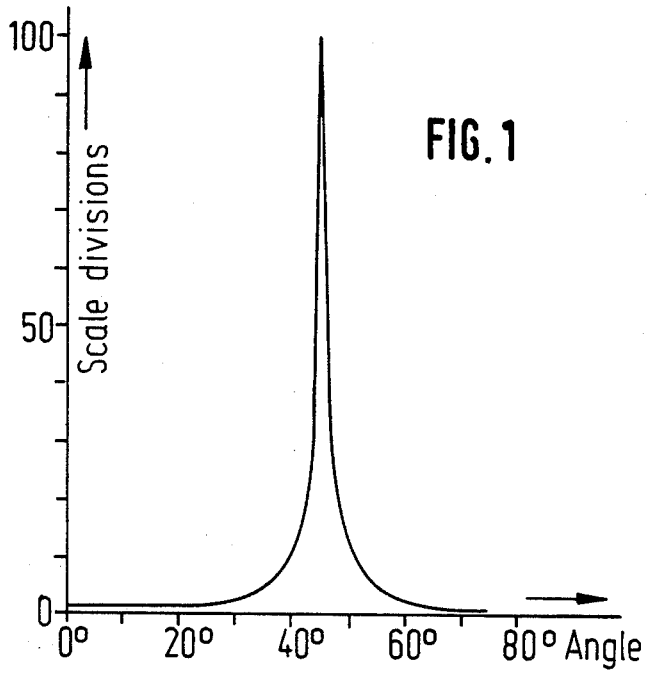
FIG. 1 shows a reflectance curve for a polished black glass slab measured at 45°.

The process according to the invention relies on the use of filament yarns or multifilaments which already have a high pre-orientation which can be described, for example by a birefringence of over $65\times10^{-3}$. In conventional spinning plants, such pre-oriented yarns are produced at take-off spinning speeds of over 4,000 meters per minute. It has now been found that such highly oriented but not yet fully drawn multifilaments can be converted with the aid of false twist texturizing machines into a slightly crimped texturized yarn if these multifilaments are exposed at temperatures of up to 30° C. above the second order transition temperature to the full false twist and simultaneous drawing. Under these chosen conditions, texturized yarns are obtained which are distinguished by a low crimp—for example that of set yarns—and, in particular, do not have any distortions of the profile of the monofilaments. The absent or extremely low deformation of the profile of the single filaments leads, on using yarns whose monofilaments have, for example, a sharp-edged triangular profile, to luster yarns which are in demand particularly for fashion effects. Filaments thus texturized additionally have a low heat shrinkage at 200° C.

In the case of a given pre-orientation of the feed yarns within the range according to the invention, the drawing and texturizing temperature then also determines the extent of the heat shrinkage, and to a small extent also the crimp, which can be expressed numerically by crimp contraction. The luster effect, ie. the retention of the profile, remains largely independent of the temperature within the temperature range according to the invention, below about 100° C. in the case of polyethylene terephthalate, as is also made clear by Example 7 and FIG. 4.

A particular luster effect, ie. a particularly low distortion of the sharp-edged profiles, is observed when using multifilaments or filament yarns which were obtained on conventional spinning plants by means of take-up speeds of approximately 4,200 to 4,800 meters per minute. At a further increase of take-off speed and associated with it a further increase of the preorientation to birefringence values of more than $120\times10^{-3}$, an increase in fluffiness is observed, which bars the use of these yarns at least when using presently customary spinning plants and texturizing machines.

The process according to the invention is fundamentally different from the process described in U.S. Pat. No. 4,173,860. In this process of the prior literature, only slightly oriented yarns which were obtained, for example, at a take-up speed of 1,000 meters per minute, are draw-texturized. When drawing these yarns a clearly visible drawing point is formed at which the diameter of the filaments suddenly decreases and a sensible heat of drawing is liberated. In particular, it may be pointed out that according to this prior literature drawing of polyester multifilaments is only possible when a small heater is additionally employed which in turn provides for an adequate exceeding of the second order transition temperature which in the case of polyesters is markedly higher than for polyamides. Such a heater is always required when using low-oriented yarns since otherwise an unevenly drawn yarn in which drawn and undrawn areas alternate is obtained.

The simultaneous false twist texturizing process described in British Pat. No. 852,579 could also not be used as a model for the present invention since it, like U.S. Pat. No. 4,173,860, is restricted merely to the processing of low-pre-oriented filament material. The process described in British Pat. No. 852,579 requires a drawing stage in a minimum ratio of 1:2. Furthermore, the examples only deal with the processing of polyamide yarns where cold-drawing is possible. When using this process, an extensively crimped yarn is obtained on releasing the crimp, and the filaments show the typical deformation into hexagonals. Yarns of this type show no or only an extremely small luster effect.

It is critical for the process according to the invention that in the simultaneous drawing and false twist texturizing the filaments or yarns do not attain temperatures which are more than 30° C. above the second order transition temperature of the drawn polymer. These temperatures certainly are exceeded when drawing customary polyamide filaments and a drawing point is formed. As a result of this, deformations of the profile of the monofilaments are unavoidable in the draw texturizing. The same is true in a corresponding manner for low-oriented polyester filaments. However, as regards the latter, there is a further negative effect in that low-oriented polyester filaments which have been taken up at speeds of, for example, 1,000 to 2,000 meters per minute, cannot be drawn evenly at temperatures below the second order transition temperature.

As will be demonstrated in detail in the examples below, it is necessary that the feed yarns for the draw false twist texturizing of profile yarns have a birefringence of about $65\times10^{-3}$ to $120\times10^{-3}$ in order that satisfactory profile retention and a low heat shrinkage are obtained.

A considerable advantage of the process according to the invention is that for the first time a draw texturizing process is provided which largely avoids the usual distortion of the filaments into hexagonals. The effect of this profile retention is a considerable improvement in the luster effect in the case of filaments which have a triangular profile. The process according to the invention however is also suitable for retaining other cross-section types, for example multilobal cross-sections with an antiluster effect, as they are described in U.S. Pat. No. 3,846,969.

The crimp values of luster yarns made according to the invention are within the range of set yarns, that is to say of yarns which have been produced on so-called double heater false twist texturizing machines or by means of a separate steaming process. However, in contrast the process according to the invention does not require a heater or only a heater which has considerably lower temperatures than otherwise customary.

The process according to the invention, surprisingly without the use of heat or only with the use of relatively low temperatures, thus produces yarns which have a low crimp contraction and low heat shrinkage and which, according to the state of the art, are only obtained by false twist texturizing processes at a temperature of the texturizing heater of over 200° C. and a similar temperature of the second setting heater, or by means of a process after the texturizing in which the wound-up texturized yarns are steamed. Furthermore, the process according to the invention produces by means of a simultaneous draw texturizing process yarns whose profile retention is even better than that of yarns obtained by separate drawing and texturizing processes, as can be seen from the examples.

This profile retention in the draw texturizing process according to the invention is also surprising because hitherto the severe deformation of the filaments into hexagonals during simultaneous draw texturizing was considered and accepted as an unpleasant characteristic of this process.

The examples which follow show a comparison of the texturized profile yarn according to the invention with conventional HE and set yarns, the limits of the claimed region of pre-orientation and the drawing and texturizing temperature, by means of the parameters crimp contraction, heat shrinkage and luster effect.

The parameters indicated there are the crimp contraction EK according to DIN 53,840, the crimp shrinkage at 120° C. as the relative change of yarn length under a load of 0.01 cN/tex before and after a heat treatment of 120° C., the heat shrinkage at 200° C. as a relative change in length under a load of 0.02 cN/tex before and after a heat treatment at 200° C. and the Knopp luster curve as a measure of profile retention and described as follows:

The luster curves were determined with the aid of a Zeiss $GP_2$ goniometer and the detailed measuring method is described by Knopp in the "Lenzinger Berichte", issued 36, February 1974, pages 160–167. For the actual measurement, parallel wound profile filaments were investigated at an illumination angle of 45° and the intensity of the reflected light was recorded as a function of the angle with the measuring plane.

This measuring method has the advantage that, apart from being closely related to the real life situation, it produces readily reproducible values which numerically reflect the change in or the distortions of the profile. In contrast, for example microscopic investigations only ever permit the examination and evaluation of small areas of monofilaments. A numerical assessment which also takes into account infrequently arising distortions is virtually only possible by means of light reflectance measurements on a relatively large number of single filaments.

Figure 4:
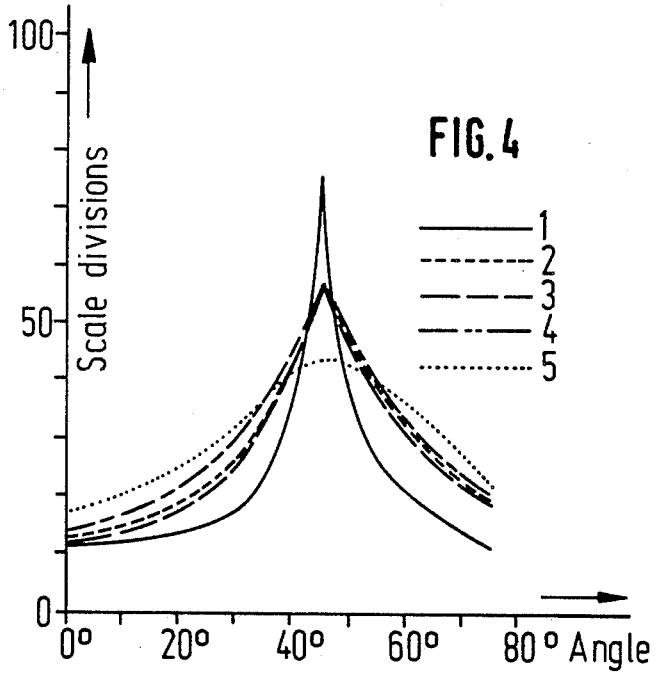
FIGS. 2–4 show reflectance curves for the yarns of the invention described herein.
Figure 2:
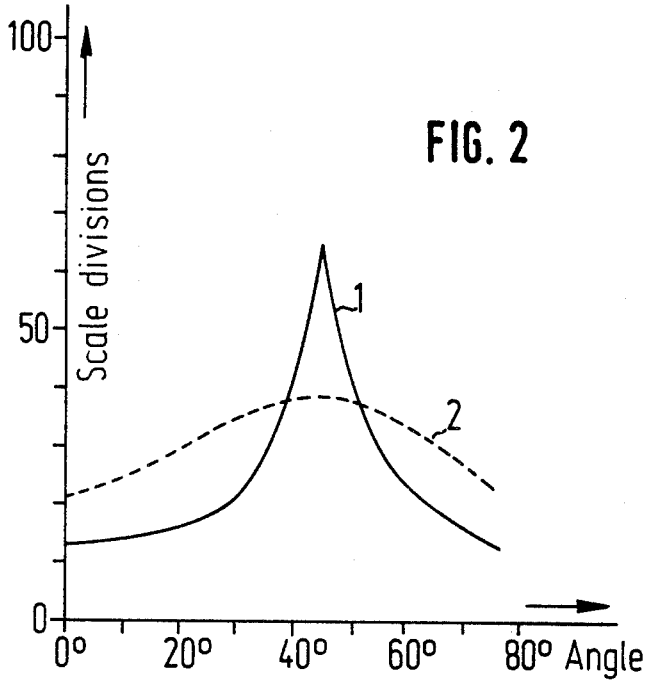
Figure 3:
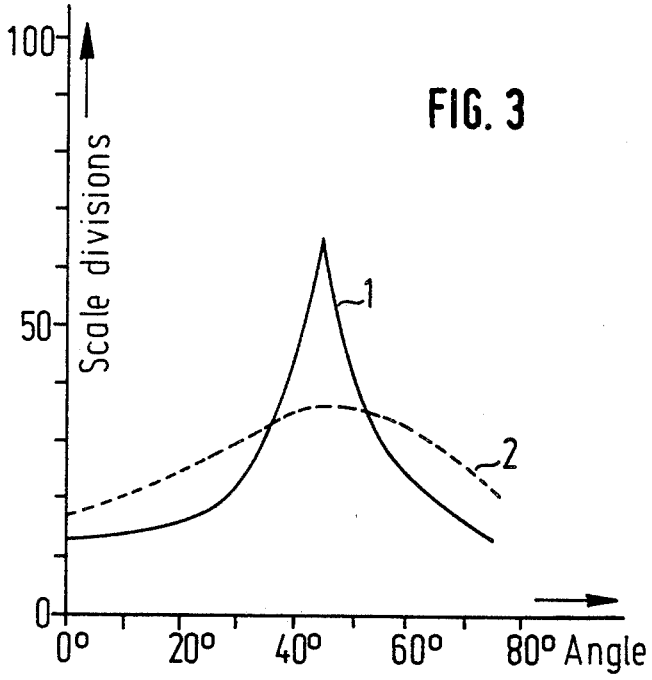

Corresponding reflectance measurements were carried out not only on the starting yarns but also on the texturized yarns produced therefrom. The experimental curves obtained are shown in FIGS. 2-4.

The values are given in arbitrary units, 100 scale divisions corresponding to the reflectance value at an angle of 45° of the polished black glass slab, the so-called black standard, belonging to the measuring instrument. FIG. 1 shows the reflectance values of this black standard as a function of the angle with the measuring plane.

The maximum value for the reflectance of the measured yarns at an angle of 45° has also been included in the tables.

EXAMPLE 1—COMPARATIVE EXAMPLE

The starting yarn used was a drawn bright 24-filament polyethylene terephthalate 76 dtex yarn (cops material), the filaments of which had a very marked triangular profile.

The textile values of this yarn are listed in the table below. This starting yarn was introduced into an FK 5 type false twist texturizing machine from Messrs. Barmag AG and turned when using only one heater into a highly elastic texturized yarn (HE yarn) and when using 2 heaters into a set yarn. The other operating conditions are listed in the table below. The false twister used was a Barmag friction false twister comprised of 3 sets of 3 sintered ceramic disks each.

It can be seen from the values in this table that in both cases a slight overfeed of the yarn onto the first heater and during the texturizing took place, in other words the filaments were definitely not additionally drawn. In the setting process, as is customary, a further overfeed of the yarn was carried out during the treatment in the second heater. To characterize the amount of twist applied, the D/Y ratio was indicated, ie. the ratio of the peripheral velocity of the false twister disks (D from disk) to the linear velocity of the yarn (Y from yarn). A further process parameter indicated is the tension of the filaments before the false twister ($F_1$) and after the false twister ($F_2$). These tensions were measured in units of cN.

| | HE process | Setting process |
|---|---|---|
| Operating speed in m/min. | 320 | 291 |
| D/Y ratio | 1.75 | 1.75 |
| Texturizing overfeed in % | +3.1 | +3.1 |
| Surface temperature of the 1st heater in °C. | 210 | 210 |
| Surface temperature of the 2nd heater in °C. | — | 230 |
| Overfeed during the setting treatment | — | 14% |
| Texturizing tension $F_1/F_2$ in cN | 16/20 | |

| | Starting yarn | HE yarn | Set yarn |
|---|---|---|---|
| Yarn count in dtex | 73.3 | 78.2 | 78.8 |
| Tensile strength in cN/tex | 40.2 | 33.2 | 27.9 |
| % elongation at break | 15.9 | 16.9 | 16.1 |
| Heat shrinkage at 200° C. in % | 28.5 | 6.9 | |
| Crimp shrinkage at 120° C. in % | | 33.0 | 9.4 |
| % crimp contraction | — | 30.6 | 7.0 |
| Relative reflectance value at 45° in number of scale divisions | 65 | 38 | 36 |

It can be seen from the table and FIGS. 2 and 3 that on texturizing even already drawn yarns the reflectance value at 45° decreases by more than 40% compared to the value for uncrimped material. FIG. 2 shows the reflectance values of the starting material (curve 1) and the resulting HE yarn (curve 2), while in FIG. 3 in addition to the starting material (curve 1) the reflectance values of the resulting set yarn (curve 2) are reproduced as a function of the angle with the measuring plane.

EXAMPLES 2-6 PRE-ORIENTATION SERIES

The examples which follow show the effect of pre-orientation on the critical parameters sharpness of profile/luster effect and 200° C. heat shrinkage.

The feed yarns used were polyethylene terephthalate multifilaments which had been obtained by means of take-up speeds of 3,000 to 4,900 meters per minute. Each of the filaments had a sharp-edged profile, the cross-section of which corresponded to an isosceles triangle. The other properties of the filaments and the texturizing temperature are shown in the table below.

Texturizing was carried out on converted draw twist machines which had been equipped with a 125 cm long contact heater and had "Kyocera" type friction false twisters with 3×3 ceramic disks from Messrs. Fischer AG. The other process conditions, in particular the surface temperature of the texturizing heater, and the test values of the resulting texturized yarns are shown in the table below. To characterize the deformation of the profiles which occurs during texturizing, the relative reflectance value, determined as described in Example 1, was used once more.

It can be seen from the table that the reflectance values increase in the maximum, ie. at an angle of 45°, with increasing birefringence of the feed yarns. Particularly good values were obtained for a take-off speed of between 4,000 and 4,900 meters per minute, which corresponds to a birefringence of 65 to $85\times10^{-3}$.

In contrast, heat shrinkage decreases with increasing orientation of the feed yarns and drops, in the pre-orientation range according to the invention, to values of below 10% at a birefringence of above $75\times10^{-3}$.

| Example No. | 2 | | 3 | | 4 | | 5 | | 6 | |
|---|---|---|---|---|---|---|---|---|---|---|
| Take-up speed in m/min | 3000 | | 3500 | | 4000 | | 4300 | | 4900 | |
| Filament yarn count in dtex | 131f24 | | 115f24 | | 104f24 | | 99f24 | | 86f24 | |
| Birefringence × $10^3$ | 33 | | 47 | | 65 | | 75 | | 85 | |
| Process values: | | | | | | | | | | |
| Surface temperature of the texturizing heater in °C. | not used | 70 | not used | 70 | not used | 70 | not used | 70 | not used | 70 |
| D/Y ratio | 1.87 | 1.87 | 1.87 | 1.87 | 1.87 | 1.87 | 1.81 | 1.69 | 1.81 | 1.69 |
| Draw ratio in 1: | 1.542 | 1.648 | 1.396 | 1.455 | 1.24 | 1.286 | 1.119 | 1.158 | 1.087 | 1.111 |
| Texturizing tension $F_1/F_2$ in cN | 32/29 | 31/28 | 32/29 | 31/27 | 32/28 | 30/23 | 24/20 | 25/22 | 26/21 | 25/24 |

-continued

| Example No. | 2 | | 3 | | 4 | | 5 | | 6 | |
|---|---|---|---|---|---|---|---|---|---|---|
| Test values: | | | | | | | | | | |
| Count in dtex | 86.3 | 81.5 | 85.0 | 80.9 | 85.1 | 81.2 | 87.1 | 84.6 | 80.2 | 77.6 |
| Tensile strength in cN/tex | 18.1 | 20.8 | 16.6 | 18.2 | 14.1 | 14.5 | 16.7 | 19.3 | 15.7 | 15.8 |
| % elongation at break | 25.0 | 21.9 | 23.4 | 20.4 | 25.8 | 21.2 | 35.1 | 34.3 | 26.9 | 23.6 |
| Heat shrinkage at 200° C. in % | 51.7 | 47.5 | 39.0 | 40.0 | 16.2 | 16.4 | 8.0 | 10.5 | 7.5 | 8.0 |
| % crimp contraction | 2.1 | 3.6 | 1.2 | 2.3 | 0.7 | 1.1 | 1.1 | 1.2 | 2.6 | 2.8 |
| Crimp shrinkage at 120° C. in % | 59.5 | 48.3 | 35.0 | 30.7 | 14.0 | 14.0 | 7.1 | 8.8 | 5.3 | 5.4 |
| Relatvie reflectance value at 45° in number of scale divisions | 45.1 | 43.5 | 45.5 | 47.5 | 49 | 46 | 49 | 50 | 50 | 48 |

EXAMPLE 7—TEMPERATURE SERIES

Starting yarns, in accordance with Example 5, were simultaneously draw texturized, in which treatment the temperature of the texturizing heater was varied between room temperature, ie. the heater was not used, and 160° C. The results of the reflectance value determinations are shown in FIG. 4. Curve 1 shows the reflectance values of the pre-oriented feed yarns and curves 2–5 the reflectance values of the resulting texturized yarns: curve 2, without heater—curve 3, at 80° C.—curve 4, at 100° C. and curve 5, at 160° C. It can be seen from this series of curves that the reflectance value at an angle of 45° which is used as a measure for profile retention in the case of normal draw texturizing drops to about half the value for smooth, non-texturized yarn. In contrast, texturizing heater temperatures up to about 100° C. produce values of about 75% of this normal value. The choice of texturizing temperatures can thus be made within the limits of the invention according to the heat shrinkage desired. A texturizing temperature of, for example, 160° C. leads to the accustomed, highly voluminous yarns which show the customary distortion of the filament cross-sections into hexagonals.

| Operating data | ←according to→ the invention | | | ←state of the art |
|---|---|---|---|---|
| Texturizing take-off in m/min | 310 | 310 | 310 | 310 |
| D/Y ratio | 1.78 | 1.69 | 1.69 | 1.81 |
| Draw ratio in 1: | 1.209 | 1.158 | 1.24 | 1.265 |
| Surface temperature of the texturizing heater in °C. | without heater | 80° | 100° | 160° |
| Texturizing tension $F_1$ in cN | 30 | 25 | 25 | 24 |
| $F_2$ in cN | 26 | 25 | 25 | 21 |
| Textile data | | | | |
| Count in dtex | 82.4 | 84.6 | 78.7 | 77.7 |
| Tensile strength in cN/tex | 15.7 | 19.3 | 20.3 | 22.7 |
| % elongation at break | 25.2 | 34.3 | 25.9 | 21.4 |
| Heat shrinkage at 200° C. in % | 10.5 | 10.5 | 13.5 | 7.0 |
| % crimp contraction | 0.8 | 1.2 | 2.9 | 28.2 |
| Relative reflectance value | 57 | 57 | 56 | 44 |

-continued

| Operating data | ←according to→ the invention | ←state of the art |
|---|---|---|
| at 45° in scale divisions | | |

What is claimed is:

1. In a process for making texturized multifilament yarns with profiled filaments the filament-forming substance of which consists of high-molecular weight polyesters, by means of false twist texturizing, the improvement comprises simultaneously false twist texturizing and drawing without reduction of the twist number feed yarns which are highly pre-oriented multifilament yarns which have a birefringence of more than $65\times10^{-3}$, while heating the yarns at no more than 30° C. above the glass transition temperature of the polymer.

2. The process as claimed in claim 1, wherein the simultaneous draw texturizing is carried out at room temperature without the use of a heating device.

3. The process as claimed in claim 1 or 2, wherein the birefringence of the feed yarns is below $120\times10^{-3}$, preferably within a range of 70 to $90\times10^{-3}$.

4. A false twist texturized yarn composed of polyester filaments having a triangular profile comprising a profile retention, represented as maximum value of the reflectance curve, of at least 65% of the value of the smooth feed yarn and a heat shrinkage at 200° C. of below 20%, preferably below 10%, said reflectance curve being determined in accordance with the method of Knopp with the aid of a Zeiss $GP_2$ goniometer on parallel wound profile filaments at an illumination angle of 45°, the intensity of the reflected light being recorded as a function of the angle with respect to the measuring plane.

5. A process as claimed in claim 1, wherein the temperature applied in said heating step is below 160° C., said glass transition temperature being more than 30° C. below 160° C.

6. A process as claimed in claim 5, wherein the temperature applied during the heating step is no greter than 100° C.

7. A process as claimed in claim 1, wherein the simultaneous draw texturizing is carried out at an applied temperature ranging from room temperature to 100° C.

* * * * *